US007533771B2

(12) United States Patent
Allison

(10) Patent No.: US 7,533,771 B2
(45) **Date of Patent: *May 19, 2009**

(54) WINDSHIELD PACKAGING SYSTEM USING PRESSURE-REGULATED CLAMPS WITH SYNERGISTIC CLAMP JAW COMPONENTS

(75) Inventor: David Allison, Troy, OH (US)

(73) Assignee: Honda Motor Co., Ltd., Tokyo (JP)

( * ) Notice: Subject to any disclaimer, the term of this patent is extended or adjusted under 35 U.S.C. 154(b) by 19 days.

This patent is subject to a terminal disclaimer.

(21) Appl. No.: 11/279,533

(22) Filed: Apr. 12, 2006

(65) Prior Publication Data

US 2006/0169610 A1 Aug. 3, 2006

Related U.S. Application Data

(63) Continuation of application No. 11/106,293, filed on Apr. 14, 2005, now Pat. No. 7,080,735, which is a continuation of application No. 10/206,735, filed on Jul. 26, 2002, now Pat. No. 6,886,692.

(51) Int. Cl.
*B65D 85/48* (2006.01)

(52) U.S. Cl. ..... 206/448; 206/454; 206/594

(58) Field of Classification Search ..... 206/448, 206/449, 451, 452, 454, 585, 594, 335; 229/915, 229/919, 940, 939
See application file for complete search history.

(56) References Cited

U.S. PATENT DOCUMENTS

| | | | | |
|---|---|---|---|---|
| 1,367,174 | A | 2/1921 | Botnen | |
| 2,769,534 | A | 11/1956 | Lidgard | |
| 2,806,592 | A | 9/1957 | Hatfield | |
| 2,967,009 | A | 1/1961 | Lidgard | |
| 3,043,488 | A | 7/1962 | Warwick | |
| 3,044,615 | A | 7/1962 | Richardson | |
| 3,289,825 | A | 12/1966 | Smith | |
| 3,317,034 | A | 5/1967 | Bowles et al. | |
| 3,371,815 | A | 3/1968 | Macomber | |
| 3,385,462 | A | 5/1968 | Deldime et al. | |
| 3,389,785 | A | 6/1968 | Lidgard | |
| 3,403,778 | A | 10/1968 | Voytko et al. | |
| 3,438,488 | A | 4/1969 | Rohde | |
| 3,519,244 | A * | 7/1970 | Lidgard | 206/454 |
| 3,589,507 | A | 6/1971 | Greenberg et al. | |
| 3,653,707 | A | 4/1972 | Pile et al. | |
| 3,692,264 | A | 9/1972 | Burkhard et al. | |
| 3,884,356 | A | 5/1975 | Lidgard | |
| 3,900,101 | A | 8/1975 | Goodsite | |
| 3,921,890 | A | 11/1975 | Reihm | |

(Continued)

FOREIGN PATENT DOCUMENTS

| | | |
|---|---|---|
| DE | 68857 | 9/1969 |

(Continued)

*Primary Examiner*—David T Fidei
(74) *Attorney, Agent, or Firm*—McDermott Will & Emery LLP

(57) ABSTRACT

A windshield packaging system that provides effective support for the windshield during substantial vertical drops, protects the windshield against side impacts, is simple in design, requires only modest skill to effectively assemble, protects windshields of different size with the same size carton, and minimizes inventory management problems. The windshield packaging system includes jaw components having a synergistic effect, horizontally-running flutes, and pressure-regulated clamps.

26 Claims, 3 Drawing Sheets

U.S. PATENT DOCUMENTS

| | | | |
|---|---|---|---|
| 4,007,837 | A | 2/1977 | Rowley et al. |
| 4,047,612 | A | 9/1977 | Lohmann |
| 4,416,384 | A | 11/1983 | Bjurling |
| 4,441,678 | A | 4/1984 | Dorpmund |
| 4,614,278 | A | 9/1986 | Gerhard |
| 4,679,525 | A | 7/1987 | Curtze |
| 4,892,193 | A | 1/1990 | Thomas |
| 4,899,880 | A | 2/1990 | Carter |
| 4,921,101 | A | 5/1990 | Gatt |
| 4,936,476 | A | 6/1990 | Dinsmoor et al. |
| 5,094,903 | A | 3/1992 | Elzey |
| 5,101,976 | A | 4/1992 | Salisbury |
| 5,154,310 | A | 10/1992 | Massey |
| 5,156,277 | A | 10/1992 | Witz |
| 5,163,572 | A | 11/1992 | Gerhard |
| 5,174,448 | A | 12/1992 | Flaig |
| 5,183,159 | A | 2/1993 | Hojnacki et al. |
| 5,269,422 | A | 12/1993 | Chevrette |
| 5,330,053 | A | 7/1994 | Tabuchi et al. |
| 5,595,301 | A | 1/1997 | Putz et al. |
| 5,605,229 | A | 2/1997 | Sowa |
| 5,682,997 | A | 11/1997 | Bartholomew |
| 5,738,218 | A | 4/1998 | Gonzales |
| 5,799,861 | A | 9/1998 | Bonner et al. |
| 5,884,778 | A | 3/1999 | Freiheit |
| 5,909,808 | A | 6/1999 | Bartholomew |
| 5,967,353 | A | 10/1999 | Gerhard |
| 6,216,873 | B1 | 4/2001 | Fosnight et al. |
| 6,286,684 | B1 | 9/2001 | Brooks et al. |
| 6,290,064 | B1 | 9/2001 | Kuhn et al. |
| 6,311,843 | B1 | 11/2001 | Smith et al. |
| 6,458,440 | B1 | 10/2002 | Merritt |
| 6,527,120 | B2 | 3/2003 | Okamoto |
| 6,581,769 | B2 | 6/2003 | Nist |
| 6,619,477 | B2 | 9/2003 | Takahashi |
| 6,626,319 | B2 | 9/2003 | Miller et al. |
| 6,705,469 | B2 | 3/2004 | Slot |
| 6,726,017 | B2 | 4/2004 | Marsh et al. |
| 6,726,046 | B2 | 4/2004 | Orset |
| 6,752,271 | B2 | 6/2004 | Allison |
| 6,789,674 | B2 | 9/2004 | Allison |
| 6,948,618 | B2 | 9/2005 | Luu et al. |
| 6,976,594 | B1 | 12/2005 | Young |
| 7,219,797 | B2 | 5/2007 | Kroeze et al. |
| 7,311,216 | B2 | 12/2007 | Donnelly et al. |
| 7,424,955 | B2 | 9/2008 | Chen |
| 2004/0007493 | A1 | 1/2004 | Morrell et al. |
| 2007/0209964 | A1 | 9/2007 | Chen |
| 2008/0067103 | A1 | 3/2008 | McDonald et al. |
| 2008/0223750 | A1 | 9/2008 | McDonald et al. |

FOREIGN PATENT DOCUMENTS

| | | | |
|---|---|---|---|
| FR | 1040979 | | 10/1953 |
| JP | 06-072482 | | 3/1994 |
| JP | 08-301372 | | 11/1996 |
| WO | WO 93/06701 | | 4/1993 |
| WO | WO 02/076848 | A1 | 10/2002 |
| WO | WO 2004/063052 | A1 | 7/2004 |
| WO | WO 2008/070734 | A2 | 6/2008 |

* cited by examiner

WINDSHIELD PACKAGING SYSTEM USING PRESSURE-REGULATED CLAMPS WITH SYNERGISTIC CLAMP JAW COMPONENTS

CROSS-REFERENCE TO RELATED APPLICATIONS

This application is a continuation of U.S. patent application Ser. No. 11/106,293, filed Apr. 14, 2005, now U.S. Pat. No. 7,080,735 B2, issued Jul. 25, 2005, entitled "Windshield Packaging System Using Pressure-Regulated Clamps With Synergistic Clamp Jaw Components," which is a continuation of application Ser. No. 10/206,735, filed Jul. 26, 2002, entitled "Windshield Packaging System Using Corrugated Box With Horizontally-Running Flutes," now U.S. Pat. No. 6,886,692, This application is also related to U.S. patent application Ser. No. 10/206,734, filed Jul. 26, 2002, entitled "Windshield Packaging System Using Synergistic Clamp Jaw Components," now U.S. Pat. No. 6,752,271, and U.S. patent application Ser. No. 10/206,283, filed Jul. 26, 2002, entitled "Windshield Packaging System Using Pressure-Regulated Clamps," now U.S. Pat. No. 6,789,674. The content of all four of these applications is incorporated herein by reference.

BACKGROUND OF THE INVENTION

1. Field of Invention

This invention relates to packaging systems and, more specifically, packaging systems for automotive windshields.

2. Description of Related Art

Automotive windshields must be carefully packaged to avoid damage to the windshields during shipment and storage. Unfortunately, many packaging systems suffer from several problems.

First, many packaging systems do not adequately support the windshield when the package is dropped.

Second, many packaging systems are susceptible to side-impact damage. These systems typically use corrugated paper for the container and must orient the flutes in the paper vertically to protect the windshield from damage when the cartons are stacked.

Third, many packaging systems are complicated to assemble, requiring significant expertise. When this expertise is not available, the windshield is often packaged in an improper manner, increasing the risk of damage.

In addition to significant risk of damage during shipment and storage, many windshield packaging systems create inventory difficulties.

Oftentimes, the interior dunnage is packaged separately from the carton. This increases the complexity of maintaining inventory of the packaging systems and sometimes results in unequal inventory levels of the various packaging components.

Many packaging systems also require cartons sizes that closely match windshield sizes to maintain an adequate level of protection during shipment and storage. In turn, this often requires a different carton size for each different size of windshield, increasing the difficulty of inventory control and reducing the amount of quantity discounts that might be obtained.

In short, existing windshield packaging systems often suffer from a variety of problems, including inadequacies in the protection of the windshields during shipment and storage and complexities and associated added expenses in their inventory control.

SUMMARY OF THE INVENTION

One object of the invention is to obviate these as well as other problems in the prior art windshield packaging systems.

Another object of the invention is to provide a windshield packaging system that reduces damage to the windshields during shipment and storage.

A still further object of the invention is to provide a windshield packaging system that protects the windshield when dropped.

A still further object of the invention is to provide a windshield packaging system that protects the windshields against substantial side impacts.

A still further object of the invention is to provide a windshield packaging system that is easy to assemble.

A still further object of the invention is to provide a windshield packaging system that requires only a modest level of skill to assemble properly.

A still further object of the invention is to provide a windshield packaging system that does not require components of the system to be separately packaged and inventoried.

A still further object of the invention is to provide a windshield packaging system in which a carton of a single size can be used to effectively protect windshields of different sizes during shipment and storage.

These as well as still further features, objects and benefits of the invention are achieved by a windshield packaging system for packaging a windshield in a manner that protects the windshield from being damaged during shipment and storage.

In one embodiment, the windshield packaging system includes a carton for housing the windshield while frictionally engaged by the clamps, the carton having a first and a second planar surface configured and oriented to surround the surfaces of the windshield and made of corrugated paper having flutes oriented to run parallel to the width of the windshield.

In one embodiment, the windshield packaging system includes a carton for housing the windshield and one or more clamps positioned within the housing, each of the clamps including a set of elongated cooperating jaws, each of the elongated jaws including an elongated piece of polyethylene sandwiched between a cling foam strip and an elongated and substantially-rigid backing member.

In one embodiment, the windshield packaging system includes a plurality of clamps in spaced-apart relationship.

In one embodiment, the plurality of clamps are configured to frictionally engage the windshield. In one embodiment, the frictional engagement is over a substantial surface area.

In one embodiment, one and only one of each of the set of jaws is affixed to the carton.

In one embodiment, the windshield packaging system further includes a pressure applicator configured to be controlled by operation of a tightening apparatus, the pressure applicator in communication with the jaws for causing the jaws to consistently press against the windshield with a certain amount of pressure regardless of whether the tightening apparatus continues to operate after the certain amount of pressure is reached.

In one embodiment, the windshield has a perimeter edge and the packaging system is configured to insure that the perimeter edge does not come in contact with any portion of the carton or the clamps during shipment or storage.

These as well as still further features, objects and benefits of the invention will now become clear upon a review of the following detailed description of illustrative embodiments, taken in conjunction with the accompanying drawings.

DETAILED DESCRIPTION OF ILLUSTRATIVE EMBODIMENTS

Figure 1:
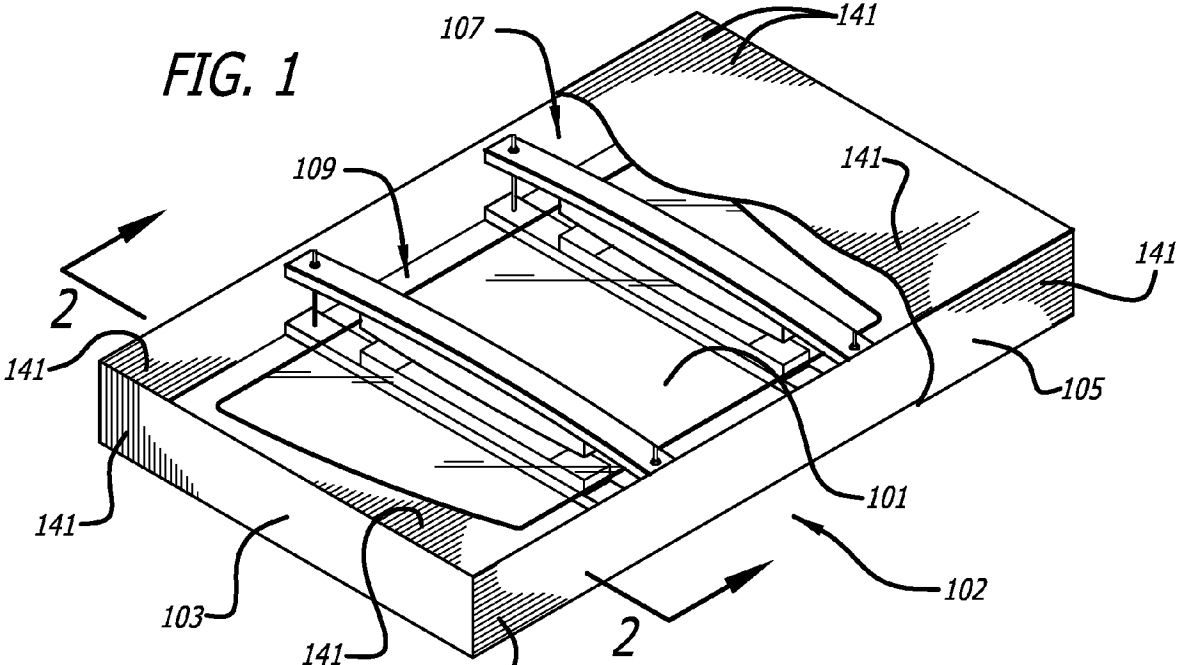
FIG. 1 is a cut away view of one embodiment of the invention with a typical windshield housed within it.

FIG. 1 is a cutaway view of one embodiment of the invention with a typical windshield housed within it.

As can be seen in FIG. 1, a typical windshield 101 is secured within a carton 102 having a bottom portion 103 and a top portion 105.

A plurality of clamps, such as clamps 107 and 109, frictionally engage the window 101 to secure the window 101 within the carton 102.

Figure 2:
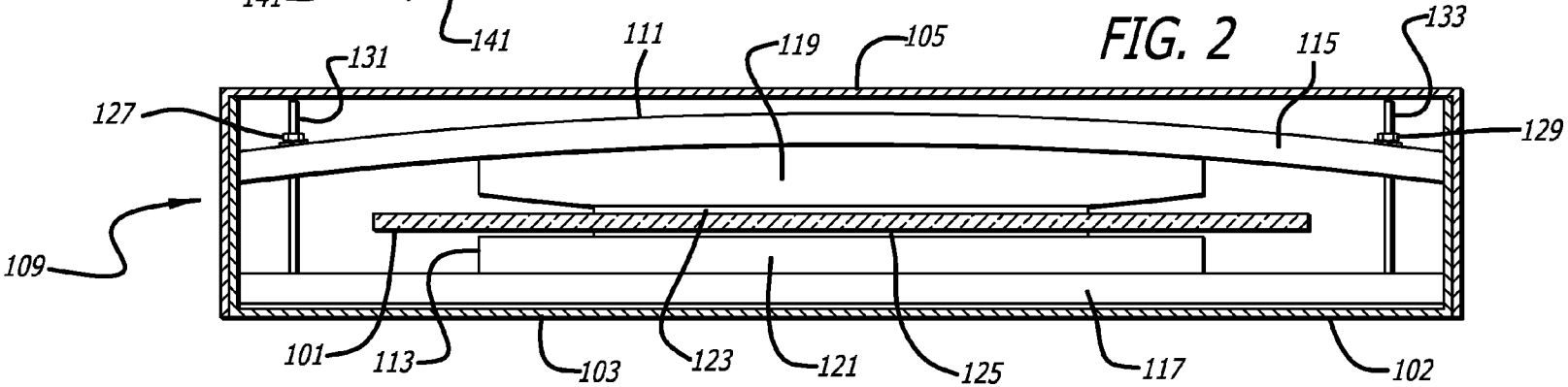
FIG. 2 is a cross-section of FIG. 1 taken along the line 2-2.

FIG. 2 is a cross-section of FIG. 1 taken along the line 2-2. FIG. 2 provides more details about each of the clamps, such as the clamp 109.

Each clamp, such as the clamp 109, includes a set of cooperating jaws, such as upper jaw 111 and lower jaw 113. Each jaw, in turn, includes an elongated and substantially-rigid backing member, such as backing members 115 and 117, an elongated length of shock-absorbing material, such as absorbing materials 119 and 121, and an elongated and thin strip of material, such as strips 123 and 125. The elongated shock-absorbing material is preferably #1.7 polyethylene. The strips are preferably cling foam. The backing member, absorbing material and strips are all preferably affixed to one another. Glue can advantageously be used for this purpose.

Each clamp also includes a pressure applicator to forcefully urge the jaws in frictional engagement with the windshield. In one embodiment, the pressure applicator includes the jaws cooperating with the transverse bolts 131 and 133 and the adjusting nuts 127 and 129 that are tightened on the transverse bolts. Although the backing members 115 and 117 are substantially-rigid, there will preferably be some flexing when under pressure.

The length of the transverse bolts 131 and 133 is preferably not greater than the height of the carton, thereby insuring that their ends do not protrude through the top 105 of the carton. On the other hand, the length of the bolts 131 and 133 are great enough to allow the nuts 127 and 129 to engage the bolts when the jaws 111 and 113 are positioned around the windshield 101.

Figure 3:
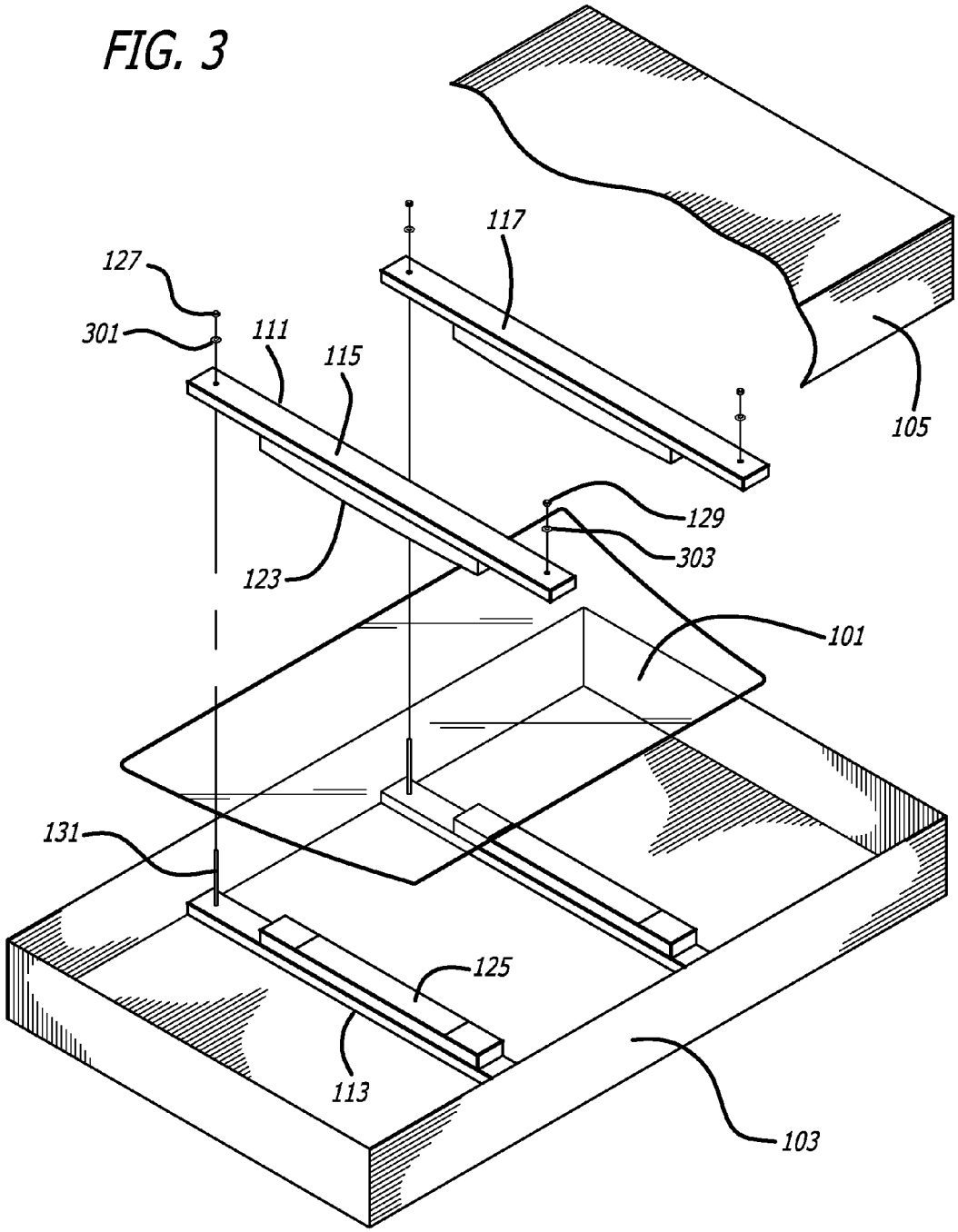
FIG. 3. is an exploded view of the embodiment of the invention shown in FIG. 1.

FIG. 3 is an exploded view of the embodiment of the invention shown in FIG. 1. It illustrates the assembly process of this embodiment of the invention.

As shown in FIG. 3, the lower jaw of each clamp, such as the lower jaw 113, is positioned in the bottom portion 103 of the container. In one embodiment, each of the lower jaws are pre-glued to the bottom portion 103 of the container.

A protective layer (not shown) preferably covers the exposed surface of each of the cling foam strips on the lower jaws, such as the cling foam strip 125, and is removed just before a windshield is fitted within the packaging system receives. The windshield 101 is then placed on top of the exposed cling foam strip of each jaw.

A protective layer (not shown) also preferably covers the exposed surface of each of the cling foam strips on the upper jaws, such as cling foam strip 123, and is similarly removed just before a windshield is fitted within the packaging system. Each upper jaw of each clamp is then fitted over the vertically-oriented bolts emanating from its respective lower jaw. A washer, such as washers 301 and 303, is then optionally placed over each protruding bolt, and the securing nuts 127 and 129 are applied and tightened. The cover 105 is then applied. The entire carton is then preferably sealed using appropriate packaging sealing techniques, such as steel bands or adhesive tape. The windshield packaging system is then ready for shipment and storage.

Figure 4:
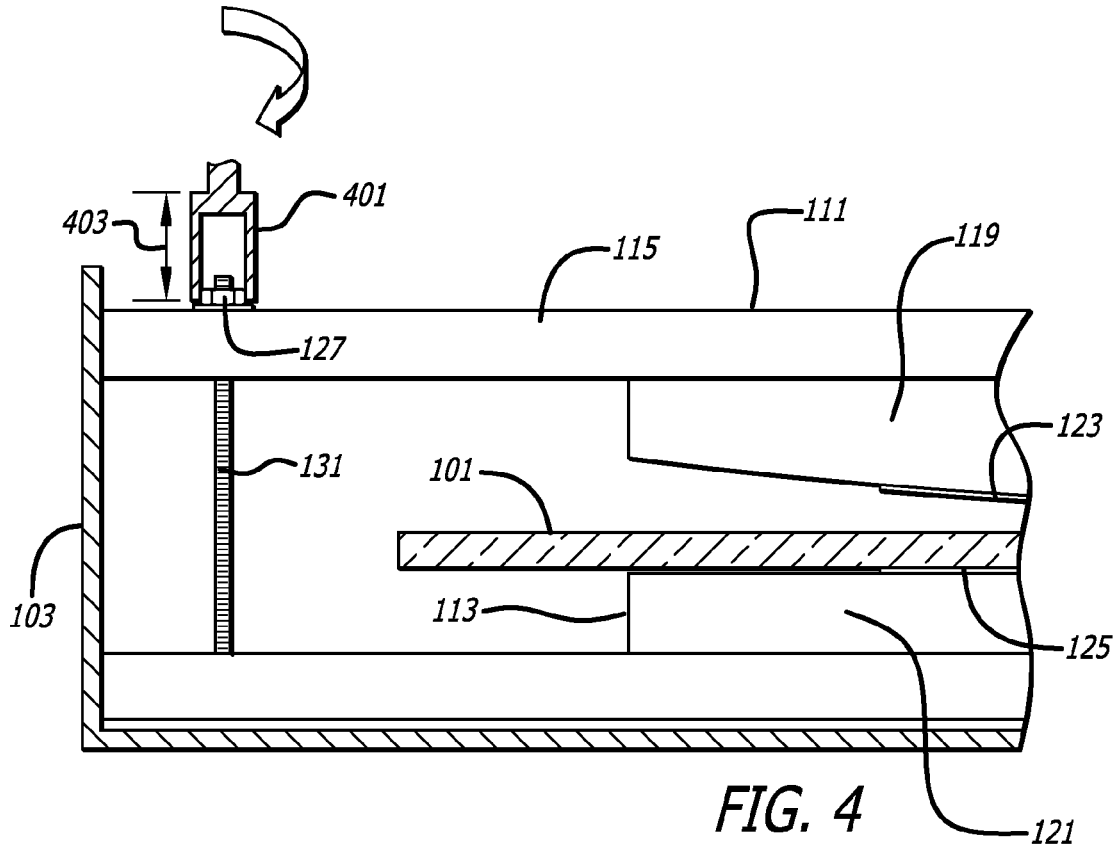
FIG. 4 is a close up of one embodiment of the pressure applicator of the invention taken along the cross-section 2-2 in FIG. 1 before pressure is applied.

FIG. 4 is a close-up of one embodiment of the pressure applicator of the invention taken along the cross-section 2-2 in FIG. 1 before pressure is applied.

As shown in FIG. 4, a socket 401 having a depth 403 is sequentially fitted over each of the nuts, such as the nut 127. The socket 401 is rotated in a direction that causes the nut 127 to tighten on the bolt 131. As the nut 127 tightens on the bolt 131, pressure is applied to the elongated and substantially-rigid backing member 115 of the jaw 111, causing the jaw 111 to begin to flex and, in turn, the jaws 111 and 113 to begin to apply pressure to the windshield 101.

Figure 5:
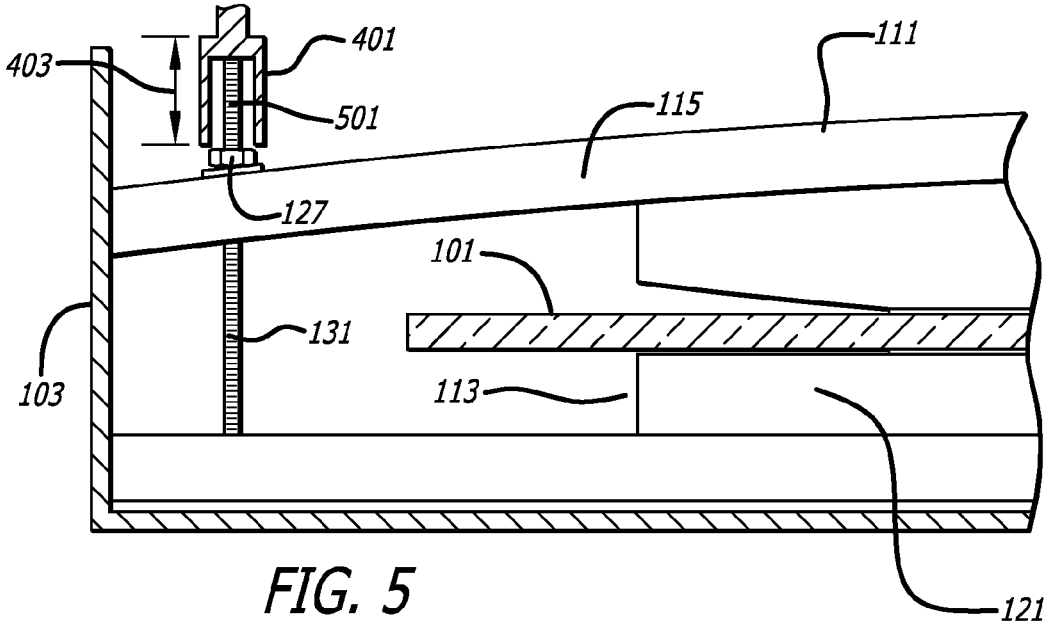
FIG. 5 is a close up of one embodiment of the pressure applicator of the invention taken along the cross-section 2-2 in FIG. 1 after the needed amount of pressure has been applied.

FIG. 5 is a close-up of one embodiment to the pressure applicator of the invention taken along the cross-section 2-2 in FIG. 1 after the needed amount of pressure has been applied. As shown in FIG. 5, the protruding free end 501 of the bolt 131 has grown to such a length as to force the nut 127 to disengage from the socket 401. In turn, this prevents further rotation of the socket 401 from causing any further tightening of the nut 127 on the bolt 131.

As should now be apparent, the amount of pressure and thus the degree of fictional engagement between the jaws 111 and 113 of the clamp and the windshield can be predetermined and fixedly-regulated. This is accomplished by selecting the length of the bolt 501 and the depth 403 of the socket 401 to cause the nut 127 to repeatedly travel down the shaft of the bolt 131 a pre-determined amount before disengaging from the socket 401. Through the use of the cooperating relationship between the free end 501 of the bolt 131 and the depth of the socket 401, a consistent degree of pressure will be applied by the cooperating jaws 111 and 113 to the windshield 101, regardless of how many times the operator rotates the socket 401. Of course, the operator must rotate the socket 401 enough times to cause the socket 401 to disengage from the nut 127. This should be a relatively easy task, as the disengagement will immediately be communicated to the operator through the cessation of resisting pressure.

The inner surface of each jaw, i.e., the portion covered by the cling foam strip, preferably engages a substantial portion of the surfaces of the windshield 101 to maximize the frictional engagement between the window 101 and the clamps.

Through the use of the invention, a carton of a single size can effectively house and protect windshields of varying size, thus eliminating the need to inventory cartons of different sizes for each differently-sized windshield.

The invention is useful in protecting glass windshield, as well as windshields made of other material. The invention is also useful for protecting other kinds of fragile and substantially-planar articles during shipment and storage.

In one embodiment, the carton is made of corrugated paper, such as corrugated paper having a weight of 275 BC. Regardless of the weight, the flutes of the corrugated paper are oriented in one embodiment to run parallel with the width of the windshield 101. In FIG. 1, the lines 141 illustrate this orientation of the flutes. With this configuration, the horizontally-running flutes provide the windshield 101 with additional protection against side impacts.

At the same time, when the surfaces of the windshield are vertically positioned and the windshield's width runs horizontally, the structure of the clamps 107 and 109 help insure that the carton will not be crushed when additional windshield packaging systems are stacked on top. Due to the degree of protection provided by the invention, it is often not necessary to instead run the flutes vertically to protect the windshield when stacked in this manner, as is done in several prior art systems.

The two clamps that are shown in FIG. 1 are preferably spaced apart, as also illustrated in FIG. 1.

Although particular embodiments of the invention have now been described, it is of course to be understood that the invention is applicable to a broad variety of other embodiments.

For example, although two clamps are shown in FIG. 1, it is to be understood that a greater number of clamps could be used or, if desired, only a single, preferably wider clamp.

Although the carton of the invention has thus-far been illustrated as comprising two separate pieces, such as the bottom 103 and the top 105, it is to be understood that the carton could be made of a single piece of material, in which case the cover would unfold from a closed to an open position, the windshield would be inserted, and the cover would be folded back to the closed position. Alternatively, the carton could be made of more than two separate sections.

The elongated and substantially-rigid backing members that are used in the jaws of the clamp, such as the backing members 115 and 117, are preferably made of wood of a type that is certified for export shipments. Materials other than wood could also be used.

Applicant has found that the combination of the three specific types of layers of material that have been discussed in this application are most effective for the jaws. However, different types or quantities of layers— including a single layer— could instead be used in alternate embodiments of the invention.

Although the lower jaw of each clamp has thus-far been described as being glued to the bottom portion of the carton 103, it is, of course, to be understood that the lower portion could be attached by other means, such as by screws. It could also be unattached.

In short, the invention is limited solely by the claims that now follow.

I claim:

1. A windshield packaging system for packaging a windshield having opposing planar surfaces comprising:

a carton having a first and a second surface, each surface having longitudinal flutes and being sized and oriented to protect at least one of the planar surfaces of the windshield when placed within the carton; and a first set of elongated cooperating jaws configured to frictionally engage the opposing surfaces of the windshield, each jaw having a length greater than a linear dimension of the surfaces of the windshield and oriented within the carton substantially perpendicular to the flutes.

2. The windshield packaging system of claim 1 wherein one of the jaws is affixed to one of the surfaces of the carton.

3. The windshield packaging system of claim 2 wherein one of the jaws is not affixed to any of the surfaces of the carton.

4. The windshield packaging system of claim 1 wherein the carton and jaws are configured to prevent the windshield from coming in contact with any portion of the carton during shipment or storage.

5. The windshield packaging system of claim 1 wherein each jaw includes an elongated piece of polyethylene sandwiched between a cling foam strip and an elongated and substantially-rigid backing member.

6. The windshield packaging system of claim 1 wherein the first surface and the second surface of the carton is made of corrugated paper.

7. The windshield packaging system of claim 1 further including an adjustable tightening apparatus connected to the jaws that causes the jaws to press against the opposing surfaces of the windshield when tightened.

8. The windshield packaging system of claim 1 further including a second set of elongated cooperating jaws configured to frictionally engage the opposing surfaces of the windshield at a location spaced apart from the location at which the surfaces of the windshield are engaged by the first set of jaws, each of the second set of jaws having a length greater than a linear dimension of the surfaces of the windshield and oriented substantially perpendicular to the direction of the flutes.

9. The windshield packaging system of claim 8 wherein one of the first and one of the second sets of jaws is affixed to one of the surfaces of the carton.

10. The windshield packaging system of claim 9 wherein one of the first set of jaws and one of the second sets of jaws are not affixed to any of the surfaces of the carton.

11. A packaging system for an article having opposing surfaces comprising:

a carton having a first and a second surface, each surface having longitudinal flutes and being sized and oriented to protect one of the surfaces of the article when placed within the carton; and a first set of elongated cooperating jaws configured to frictionally engage the opposing surfaces of the article, each jaw having a length greater than a linear dimension of the surfaces of the article and oriented within the carton substantially perpendicular to the flutes.

12. The packaging system of claim 11 wherein one of the jaws is affixed to one of the surfaces of the carton.

13. The packaging system of claim 12 wherein one of the jaws is not affixed to any of the surfaces of the carton.

14. The packaging system of claim 11 wherein the carton and jaws are configured to prevent the article from coming in contact with any portion of the carton during shipment or storage.

15. The packaging system of claim 11 wherein each jaw includes an elongated piece of polyethylene sandwiched between a cling foam strip and an elongated and substantially-rigid backing member.

16. The packaging system of claim 11 wherein the first surface and the second surface of the carton is made of corrugated paper.

17. The packaging system of claim 11 further including an adjustable tightening apparatus connected to the jaws that causes the jaws to press against the opposing surfaces of the article when tightened.

18. The windshield packaging system of claim 11 further including a second set of elongated cooperating jaws configured to frictionally engage the surfaces of the article at a location spaced apart from the location at which the surfaces of the article are engaged by the first set of jaws, each of the second set of jaws having a length greater than a linear dimension of the surfaces of the article and oriented substantially perpendicular to the flutes.

19. The windshield packaging system of claim 18 wherein one of the first and one of the second sets of jaws are affixed to one of the surfaces of the carton.

20. The windshield packaging system of claim 19 wherein one of the first set of jaws and one of the second sets of jaws are not affixed to any of the surfaces of the carton.

21. A windshield packaging system for packaging a windshield having a length and a width less than the length comprising:

a carton having a first and a second surface, each surface having a length greater than the length of the windshield, a width greater than the width of the windshield and less than the length of the windshield, and longitudinal flutes running substantially parallel to the length of the carton; and an elongated member having a first engagement mechanism configured to engage a surface of the windshield and a length that is approximately the same as the width of the carton, wherein the elongated member is configured such that it fits snuggly within the confines of the width of the carton.

22. The windshield packaging system of claim 21 wherein the elongated member is affixed to the first or the second surfaces of the carton.

23. The windshield packaging system of claim 21 wherein the carton, elongated member and engagement mechanism are configured to prevent the windshield from coming in contact with any portion of the carton during shipment or storage.

24. The windshield packaging system of claim 21 wherein the first surface and the second surface of the carton is made of corrugated paper.

25. The windshield packaging system of claim 21 further including a second elongated member having a second mechanism configured to frictionally engage the surface of the windshield at a location spaced apart from the location at which the surface of the windshield is engaged by the first mechanism, the second elongated member having a length greater than a linear dimension of the surface of the windshield and oriented substantially perpendicular to the flutes.

26. The windshield packaging system of claim 25 wherein the first and the second elongated members are affixed to one of the surfaces of the carton.

* * * * *